United States Patent [19]

Darby

[11] 4,113,252

[45] Sep. 12, 1978

[54] REBOUNDING BALL GAME

[76] Inventor: Ronald L. Darby, 1910 N. Kenmore, North Hollywood, Calif. 90027

[21] Appl. No.: 763,427

[22] Filed: Jan. 28, 1977

[51] Int. Cl.[2] ..... A63B 63/00; A63B 69/00

[52] U.S. Cl. ..... 273/95 R; 273/1.5 A

[58] Field of Search ..... 273/1.5 R, 1.5 A, 95 R, 273/95 H, 102 R, 102 S, 102 B, 103; 272/109, 62, 63, 112, 113

[56] References Cited

U.S. PATENT DOCUMENTS

| | | | |
|---|---|---|---|
| D. 160,320 | 10/1950 | Horowitz | 272/113 X |
| 3,120,955 | 2/1964 | Carlin | 272/113 |
| 3,211,452 | 10/1965 | Ahrens | 272/109 X |
| 3,582,078 | 6/1971 | Katras et al. | 273/95 R X |
| 3,599,978 | 8/1971 | Sondergaard | 273/95 R |
| 3,638,945 | 2/1972 | Breslow | 273/95 R |
| 3,802,702 | 4/1974 | Pulley | 273/1.5 R |

*Primary Examiner*—William H. Grieb
*Attorney, Agent, or Firm*—Lyon & Lyon

[57] ABSTRACT

Disclosed herein is a game for exercising one's body and improving reflexes which is comprised of an overhead structure defining a plurality of angularly disposed rebounding members which is supported by a plurality of legs, and a ball. The game is played by directing the ball over the structure such that it encounters the rebounding members during its descent and rebounding vigorously as it passes through the structure. One or more players then attempt to catch the ball in its erratic flight before it strikes the ground, exercising several different muscles and developing their reflexes in the process.

4 Claims, 4 Drawing Figures

REBOUNDING BALL GAME

In recent years the public has become increasingly aware of the importance of physical fitness. Concurrent with this trend is the increasing popularity and participation in the martial arts, such as karate. Studying the martial arts requires extensive and constant exercising not only to learn the different movements but to develop various muscles and quick reflexes. While several devices have been developed and are currently on the market for use in physical development, such devices do little in aiding one in quickening his reflexes. Accordingly, additional exercises are necessary making the study of the martial arts a difficult and laborious process. It would therefore be highly desirable to develop an apparatus which not only exercises one's body but quickens his reflexes as well.

Physical development like the mental process of learning is always facilitated when made enjoyable, hence the popularity and encouragement of youngsters and adults as well to engage in athletic games of varying activity depending upon their age and physical condition. Consequently, any exercising device, the use of which could be made enjoyable would meet with increasing popularity and improved results. Accordingly, the present invention is directed to an apparatus which both develops one's muscles and quickens his reflexes and is adapted to be used in a game situation.

Briefly, the invention comprises an overhead structure which is supported by a plurality of legs and which defines a plurality of angularly disposed rebounding members. Upon directing a ball over the structure such that it contacts the structure, it is caused to rebound vigorously during its descent. By endeavoring and ideally catching the ball before it strikes the ground, one exercises his muscles, develops mental and physical coordination and quickens his reflexes. In this manner, the device makes the type of exercise necessary for the studying of the martial arts a pleasurable as well as a developing experience.

It is the principal object of the present invention to develop a device for exercising the body in the study of the martial arts.

It is another object of the present invention to provide an exercising device which both develops one's muscles and quickens his reflexes.

It is a further object of the present invention to provide an exercising device which is adapted to be used in a game situation making its use more enjoyable and consequently productive.

It is a still further object of the present invention to provide a game, the playing of which develops the body muscles and reactions of the players.

These and other objects and advantages of the present invention will become apparent from the following detailed description taken in conjunction with the accompanying drawings.

Figure 1:
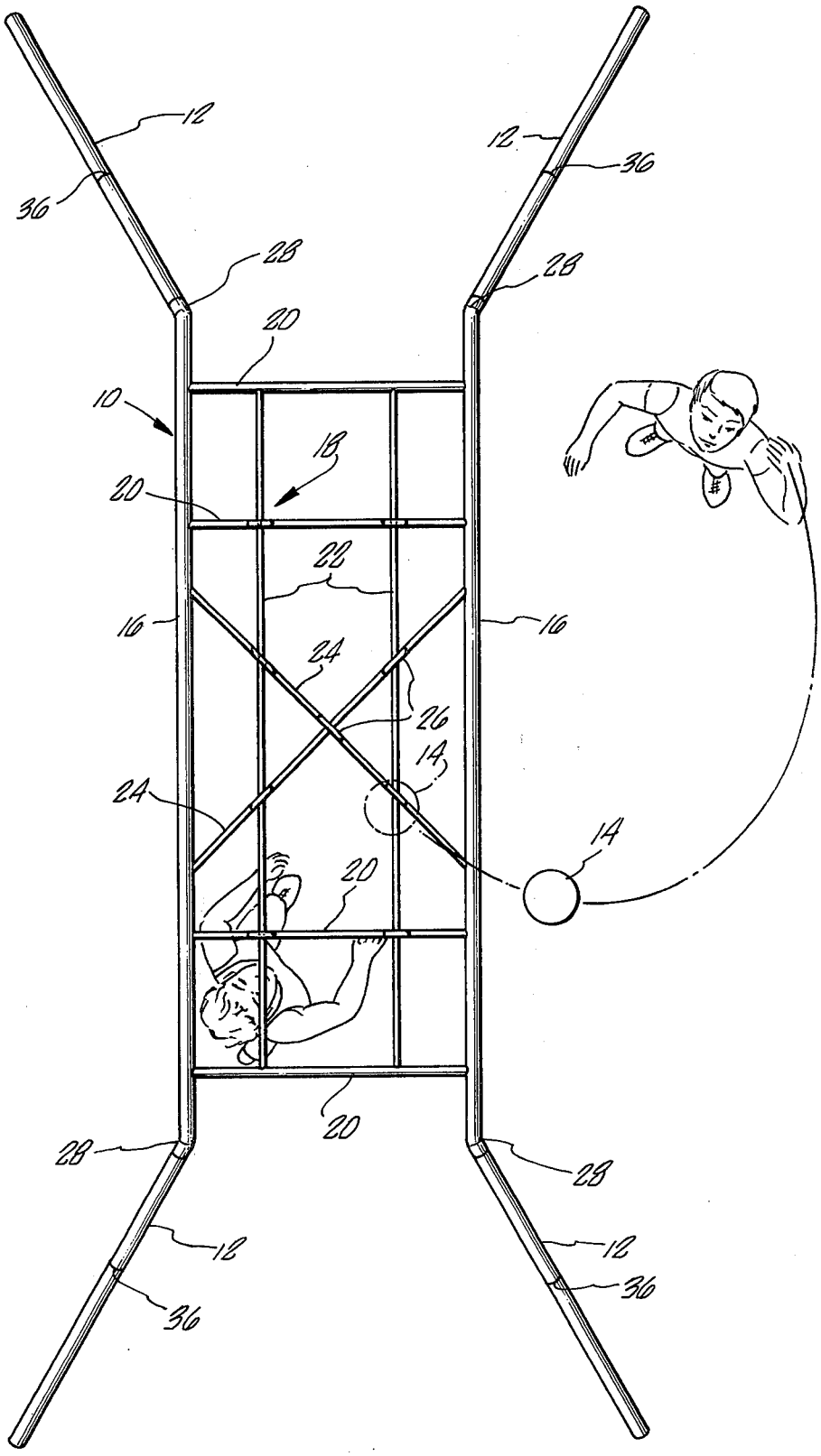
FIG. 1 is a plan view of the structure of the present invention illustrating two players in a game situation.
Figure 2:
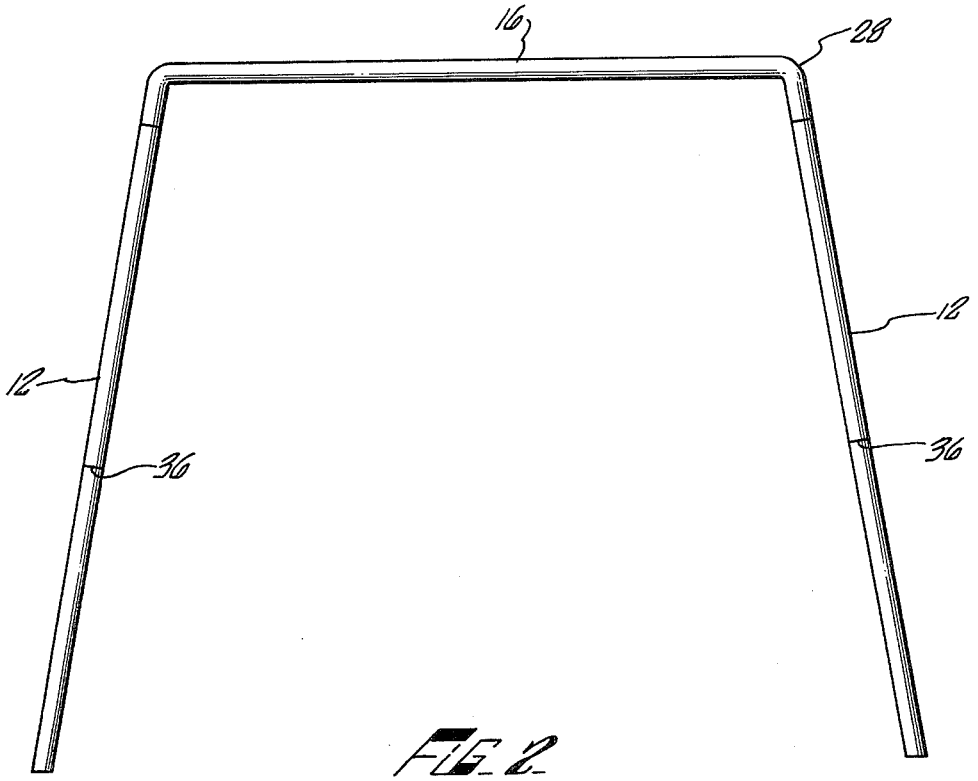
FIG. 2 is a side view of the structure of the present invention.

Referring now in detail to the drawings, the apparatus of the present invention is comprised of a structure 10 which is supported by a plurality of extended leg members 12 and a ball 14. The structure 10 is carried by the leg members such that it is horizontally disposed over the heads of the players and is comprised of a pair of rebounding end supports 16 and a plurality of disposed rebounding members 18. The configuration of rebounding members illustrated in the drawings include four transverse members 20, a pair of inner longitudinal members 22 and a center pair of crossed angular members 24. While several different configurations of rebounding members could, of course, be employed, it is highly desirable to incorporate a configuration defining several different angles for reasons which will become apparent.

Figure 3:
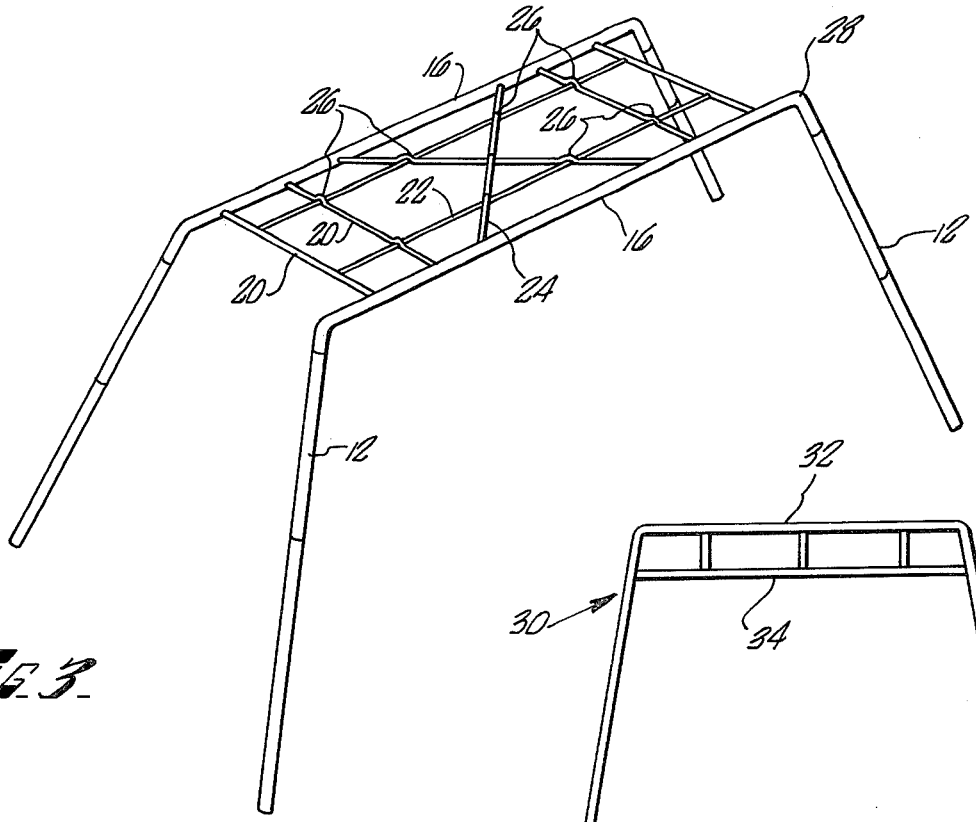
FIG. 3 is a perspective view of the structure of the present invention.

In the preferred construction of the apparatus, the different rebounding members lie in substantially the same plane and are so interconnected that the structure can be readily disassembled for transportation. This can be accomplished by merely inserting the ends of the rebounding members 18 in apertures provided in the enlarged end supports 16 so that the members 18 are held therein by a pressure fit. In the configuration of rebounding members 18 illustrated in FIG. 1, apertures could be similarly provided in the inner two transverse members 20 and center cross members 24 for the smaller inner longitudinal members 22 to be inserted therethrough, as well as in the outer two transverse members 20 to receive the ends of the inner longitudinal members 22. As an alternative to apertures extending through the rebounding members 18, the various points at which such members intersect can be accommodated either by slightly flattening those members at the points of intersection, or by providing one or both intersecting rebounding members with a U-shaped configuration at the points of intersection, illustrated at 26 in FIG. 3. The leg members 12 can be secured to the end supports 16 by a telescoping or other suitable detachable connection and preferably extend outwardly therefrom at an angle of about 30° to dispose the legs outwardly from the structure 10. The legs are then bent downwardly and again preferably outwardly at 28 from which they extend to the ground.

The use of the structure in a game situation can take many forms and can be played by one or more players. Essentially, one of the players who stands below and in front of the structure throws the ball high above the structure which preferably extends about eight feet above the ground. One or two players stand to the side of the structure and after the ball is thrown, position themselves so as to catch the ball before it strikes the ground. In its downward flight the ball may strike the rebounding members, rebounding vigorously in different directions. The object of the game is for the thrower, or server, to direct the ball so that it strikes the ground without being touched while the receivers attempt to catch the ball. Points can be awarded to the server if he catches his own serve whereupon he could also retain his serve. While numerous variations in play could be designed, the use of the structure under any rules provides body building exercises while quickening one's reactions, thereby serving as an excellent aid for use in the study of the martial arts.

While in the preferred embodiment of the invention the rebounding members are disposed in a common horizontal plane, as described above, the rebounding members need not all be disposed in the same plane.

Figure 4:
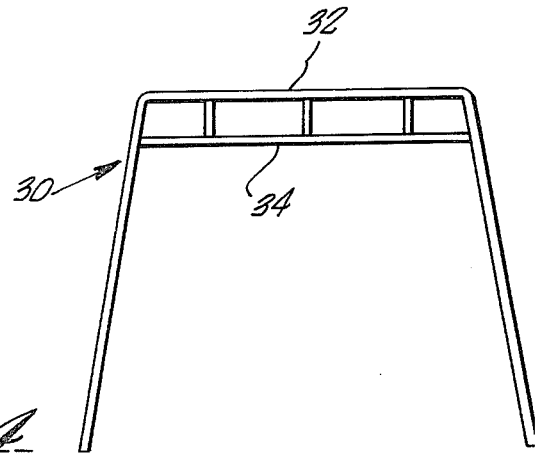
FIG. 4 is a modification of the structure of the present invention.

FIG. 4 illustrates a structure 30 having rebounding members which are carried by end supports 32 and 34 and which lie in different horizontal planes to present rebounding members at different vertical levels. In addition, the rebounding members could be angularly disposed with respect to the ground as opposed to the horizontal disposition of the preferred embodiment.

To facilitate angular mounting of the rebounding members as well as disassembly for carrying, each of the leg members 12 is preferably of two piece construction and telescoped together at 36. By removing the leg extensions at one end of the structure and supporting that end against a building or the like, a sloped or angular playing surface is obtained. Various other changes and modifications can be made in carrying out and utilizing the present invention without departing from the spirit and scope thereof. Insofar as these changes and modifications are within the purview of the appended claims, they are to be considered as part of the invention.

I claim:

1. A rebounding ball game comprising a playing structure and means for supporting said structure above the heads of the players, said structure being comprised of a plurality of ball rebounding bars, two of said bars defining longitudinal end supports and others of said bars being disposed therebetween in substantially the same plane as said end supports and carried thereby such that said others of said bars intersect said end supports and each other in a plurality of different angles whereby upon directing a ball over said structure and upon said ball contacting said bars, said ball rebounds between said bars in different directions rapidly altering the path of the descent of said ball and thereby rendering more difficult the attempt to catch said ball prior to the ball striking the ground.

2. The combination of claim 1 wherein said supporting means supports said structure in a substantially horizontal disposition and comprises a plurality of leg members adapted to be secured to said end supports, said leg members upon being secured to said end supports extend downwardly and outwardly therefrom to define a playing area bordered by the lower ends of said leg members below said structure, said playing area being greater than the area defined by said structure.

3. The combination of claim 1 wherein said end supports are provided with a plurality of apertures therein for receiving the end portions of a plurality of said others of said rebounding bars thereby supporting said others of said rebounding bars while allowing said bars to be pulled therefrom to facilitate disassembly for transporting said structure.

4. A rebounding ball game comprising a pair of longitudinal end supports, a plurality of bars carried by said supports, said end supports and said bars defining a rebounding structure and a plurality of leg members secured to said end supports and extending downwardly and outwardly therefrom to define a playing area bordered by the lower ends of said leg members below said rebounding structure, said end supports having a plurality of apertures therein for receiving the end portions of a plurality of said bars and carrying said bars such that said bars are disposed between said end supports in substantially the same plane as said end supports and intersecting said end supports and each other in a plurality of different angles whereby upon directing a ball over said structure and upon said ball contacting said bars, said ball rebounds between said bars in different directions rapidly altering the path of the descent of said ball and thereby rendering more difficult the attempt to the ball striking the ball within the playing area.

* * * * *